United States Patent [19]

Jones et al.

[11] 4,373,272

[45] * Feb. 15, 1983

[54] SYSTEM FOR CONTROLLING SPOUTED BED INLET CONDITIONS

[75] Inventors: Thomas B. Jones, Fort Collins, Colo.; Morris H. Morgan, Clifton Park; Peter W. Dietz, Delanson, both of N.Y.

[73] Assignee: General Electric Company, Schenectady, N.Y.

[ * ] Notice: The portion of the term of this patent subsequent to Sep. 21, 1999, has been disclaimed.

[21] Appl. No.: 190,816

[22] Filed: Sep. 25, 1980

[51] Int. Cl.[3] ..... F26B 17/00

[52] U.S. Cl. ..... 34/57 A; 406/143; 34/102

[58] Field of Search ..... 406/138, 142, 143, 146, 406/127; 55/138; 34/10, 57 R, 57 A

[56] References Cited

U.S. PATENT DOCUMENTS

| | | | |
|---|---|---|---|
| 2,786,280 | 3/1957 | Gishler et al. | 34/10 |
| 2,806,744 | 9/1957 | Hall et al. | 406/143 |
| 2,826,460 | 3/1958 | Cameron et al. | 406/142 |
| 2,839,339 | 6/1958 | Mills | 406/142 |
| 3,304,249 | 2/1967 | Katz et al. | 34/10 X |
| 4,038,052 | 7/1977 | Melcher et al. | 55/138 |
| 4,262,034 | 4/1981 | Anderson | 406/138 X |

OTHER PUBLICATIONS

"Bubble Control in Gas Fluidized Beds with Applied Electric Fields", G. M. Colver, 1976.

"Electric Field Phenomena in Fluidized and Fixed Beds", H. Katz and J. T. Sears, 1969.

"Electromechanics of Electrofluidized Beds", T. W. Johnson and J. R. Melcher, 1975.

*Primary Examiner*—John J. Love

*Assistant Examiner*—Gene A. Church

*Attorney, Agent, or Firm*—Paul J. Checkovich; James C. Davis, Jr.; Marvin Snyder

[57] ABSTRACT

Semi-insulating granular bed material in a spout inlet region of a spouted bed vessel between a draft tube and a portion of the vessel base section adjacent a fluid inlet is aligned along the force lines of an imposed localized electric field to thereby afford improved control over spout inlet conditions which affect processes carried out in the spouted bed device.

14 Claims, 3 Drawing Figures

SYSTEM FOR CONTROLLING SPOUTED BED INLET CONDITIONS

BACKGROUND OF THE INVENTION

This invention relates to an improved spouted bed device, and more particularly, to an electric field coupled spouted bed device and a method for controlling the spout inlet conditions thereof.

A related copending application is application Ser. No. 194,630 filed Oct. 6, 1980, which is assigned to the same assignee as that of the present application.

Spouted bed devices are widely employed in material processing operations such as grain drying, tablet coating, pneumatic transport, and in chemical reaction systems. The basic design and operation of spouted bed devices is well known in the art as evidenced by numerous publications including *Spouted Beds,* K. B. Mathur and N. Epstein, Academic Press, New York, 1974. An exemplitive spouted bed device is described in U.S. Pat. No. 2,786,280 (Gishler et al) which is incorporated herein by reference.

Conventional spouted bed devices typically include a bed of granular material into which a jet of fluid such as air is directed to form a spout in which a portion of the granular material is entrained. These conventional devices offer little control flexibility since variable parameters such as fluid flow rate and bed height are dependent on the properties of a given bed material. Accordingly, these parameters can only be varied within a narrow range, if at all.

More recently, pipe inserts or "draft tubes" have been positioned in the bed region above the vessel fluid inlet to force a large percentage of the fluid to travel up through the bed without diffusing therein, except in a spout inlet region between the fluid inlet and the draft tube inlet. In this manner the minimum fluid flow rate required for useful operation of a spouted bed device with a given bed material is reduced, allowing a somewhat greater operational flexibility. However, variable control remains limited over spout inlet conditions which can directly affect any associated material processing operation.

For example, the recirculation rate of bed material is potentially variable as a function of the fluid flow rate at the spout inlet. However, the minimum flow rate required for spouting in such a device with a given bed material can be varied only by physically adjusting the separation distance between the fluid and draft tube inlets, which is a rather complicated task. Additionally, as the flow rate is increased a greater percentage of the fluid diffuses and inefficiently bypasses the draft tube inlet. Further increases in the flow rate results in additional flow bypassing which may disrupt the solids movement in the granular bed with a corresponding loss of process control.

Accordingly, it is an object of the present invention to provide a means and a method for variably controlling processes carried out in a spouted bed device.

It is also an object of the present invention to provide an improved means for controlling the recirculation rate of granules in a spouted bed device.

It is a further object of the present invention to provide a means for channeling fluid from a fluid inlet into a draft tube of a spouted bed device upon an increase in the fluid flow rate.

Another object of the present invention is to enable the control of the solids delivery rate for a pneumatic transport system.

Still another object of the present invention is to provide a spouted bed device that may be employed with a variety of granular materials and fluid flow rates without requiring modifications to the geometry thereof.

SUMMARY OF THE INVENTION

The above and other objects and advantages are achieved in a spouted bed device which includes a draft tube equipped vessel for containing semi-insulating granular material. The inlet of the draft tube is positioned in the vessel opposite of and spaced from a fluid inlet in a vessel base section. A means is provided for forming a localized electric field in a spout inlet region between the draft tube inlet and at least a portion of the vessel base section adjacent the fluid inlet. When the means are activated, granules of bed material tend to align along the force lines of the electric field and to resist entrainment into the fluid flowing through the spout inlet region. By adjusting the strength of the electric field the number of granules entrained into the fluid may be varied, thereby enabling the control of the recirculation rate in a spouted bed reactor, or control of the solids delivery rate of a pneumatic transport system. Similarly, the imposition of an appropriate electric field in the spout inlet region also enables the channeling of fluid flow into the draft tube.

BRIEF DESCRIPTION OF THE DRAWING

Other objects, features and advantages of the present invention may be appreciated from the accompanying drawing in which.

DETAILED DESCRIPTION OF THE DRAWING

Figure 1:
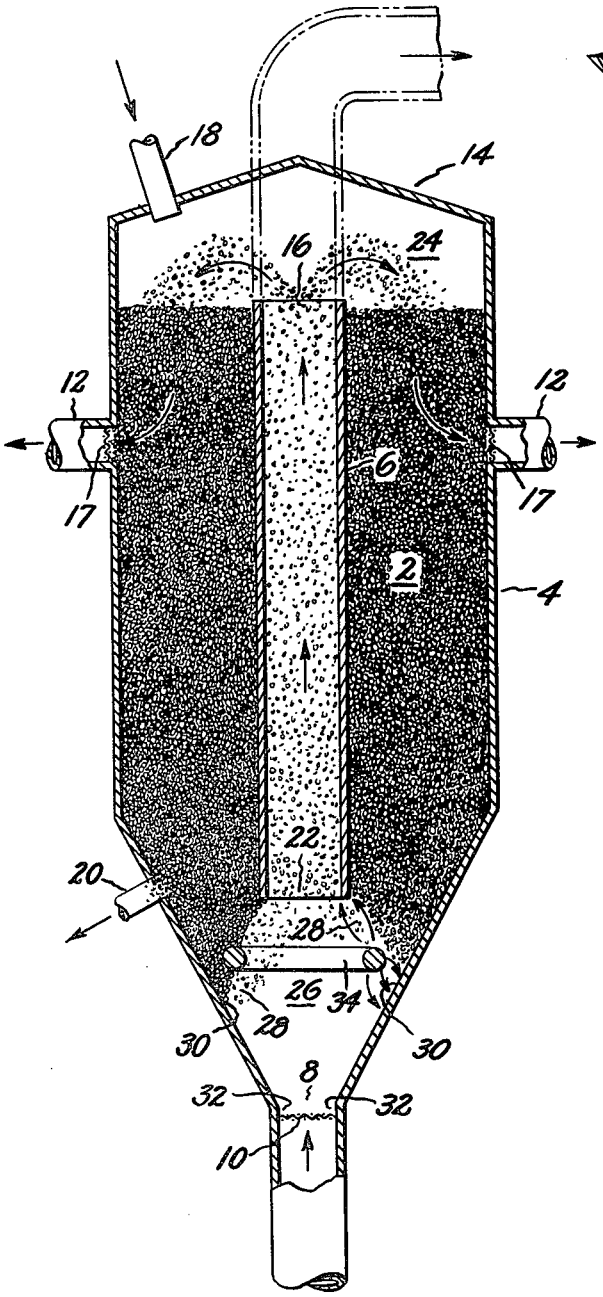
FIG. 1 is a schematic longitudinal sectional view of a spouted bed reactor according to an embodiment of the present invention, with a second embodiment comprising a pneumatic transport system depicted in phantom.

In a preferred embodiment of the present invention depicted in FIG. 1 a bed 2 of semi-insulating granular material is located in an annular region of a vessel 4 between the interior surface of the vessel and a draft tube 6. The vessel includes a vertical cylindrical upper section and a frustoconical base section. A fluid inlet 8 is provided at the apex of the base section. A screen 10 is positioned below the fluid inlet 8 to prevent bed material from entering the fluid supply system during periods of low flow while minimizing any disruption to the fluid flow path in the vessel. The vessel 4 is also provided with side fluid outlets 12 formed in the upper portion of the vessel in contact with the bed material. Correspondingly, the vessel is provided with a cover 14 suitable for forcing the fluid flowing from the draft tube outlet 16 to exhaust through the side outlets 12. Screens 17 are included in the outlets 12 to prevent undesirable bed material transfer from the vessel. A conventional granule inlet 18 and outlet 20 are provided to replenish the bed and to discard used granules, respectively.

In the embodiment depicted in FIG. 1 the draft tube 6 is suspended coaxially within the vessel 4 by conventional supports not herein illustrated. The draft tube inlet 22 is spaced above the fluid inlet 8 at a distance much greater than the cross dimension of the granular material in the bed 2. Typically, the draft tube inlet 22 is positioned a distance of approximately two draft tube diameters above the fluid inlet 8. The draft tube outlet 16 is located in a fountain region 24 of the vessel between the top of the granular bed 2 and the vessel cover 14.

The material contained in the bed 2 includes semi-insulating granules. Thus, the bed granules are not so highly insulating that their electromechanical response to an imposed electric field would be largely determined by relatively uncontrolled factors such as frictional electrification. On the other hand, the particles are not so highly conducting as to pose a limitation on the strength of fields that can be imposed due to electrical breakdown or electrical heating. Since conduction in the present invention typically occurs on the surface of the granules, the electrical conduction thereof is often determined by relative humidity. Accordingly, even relatively insulating granules may be semi-insulating in a given environment. Thus, the term "semi-insulating granules" as used herein includes particles having relatively conductive surfaces in an environment of interest which granules in other environments or applications may be considered as being relatively insulating or relatively conducting.

The bed 2 of granular material is operationally separated from a spout region 26 by a region 28 in the vessel herein termed a spout inlet region. This region 28 extends from the draft tube inlet 22 to a portion 30 of the vessel base section adjacent the fluid inlet 8. Of course, the base portion 30 may include part of the fluid inlet structure 32 in certain applications, as where the inlet structure extends into the interior of the vessel base section.

An annular or ring electrode 34 is positioned in the spout inlet region 28 approximately midway between the draft tube inlet 22 and the base portion 30. The electrode 34 is connected to a conventional variable voltage source (not herein illustrated) while the draft tube inlet 22 and the base portion 30 are suitably grounded (not herein illustrated). Thus, upon the application of an electrical potential to the electrode 34 an intense localized electric field is formed in the spout inlet region 28.

In operation, granular material supplied to the bed 2 through the inlet 18 is fed by gravity towards the spout inlet region 28 where granules are entrained in a flow of fluid such as air entering through the inlet 8. The entrained granules are transported in a dilute suspension through the draft tube 6. In the fountain region 24 the dilute suspension is diffused, causing the entrained granules to settle by gravity on to the top of the bed 2. The diffused fluid travels downward through the bed 2 to the outlets 12 and is exhausted from the vessel. Processed granules are discarded through the outlet 20. The processed granules may, for example, include dried grains in a drying application or depleted granules of a catalytic material in a chemical reactor application.

Upon application of a sufficient voltage to the electrode 34 an electric field is formed in the spout inlet region 28. The semi-insulating granules tend to be aligned along the force lines of the field. The resulting electrical forces tend to restrain granule entrainment into the fluid flowing through the region 26. The tendency of the granules to resist entrainment increases with the applied voltage until a voltage is reached at which granules are no longer entrained such that the bed is said to be frozen.

Accordingly, by adjusting the strength of the electric field in the spout inlet region 28 the recirculation rate of granules from the bed 2 to the fountain region 24 may be controlled. Similarly, the aligned granules tend to channel the fluid flow from the inlet 8 into the draft tube inlet 22. Thus, the aforementioned diffusion of fluid flow with increasing velocity and associated bypassing of the draft tube inlet 22 can be avoided by the application of a suitable voltage in the spout inlet region. Additionally, rapid variations in the field strength can produce a controlled "slugging" process in which relatively large quantities of granules are entrained at periodical intervals. This type of operation is particularly useful in conjunction with granules which are relatively adhesive and which might otherwise tend to adhere to each other so as to block the draft tube inlet 22.

Figure 2:
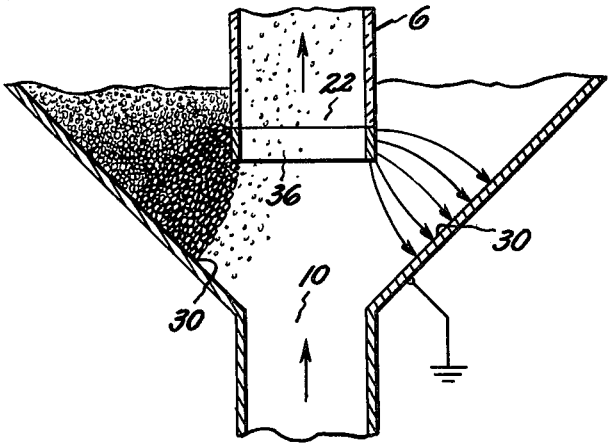
FIG. 2 is an enlarged schematic view of the vessel base portion illustrated in FIG. 1, depicting an alternative embodiment of the present invention.

Of course, the operation described hereinabove is equally adaptable to a pneumatic transport system as depicted in phantom in FIG. 1. In such a system, fluid outlets 12 are typically not provided for in the vessel 4. Rather, the draft tube is extended out of the vessel with the outlet 16 positioned at a point of desired transport (not herein illustrated). Similarly, the present invention is also useful in spouted bed devices employing top rather than side fluid outlets, the difference being one of design preference. Moreover, the present invention is not limited to a particular electrode structure. Thus, in the embodiment depicted in FIG. 2 in which the draft tube inlet 22 is positioned somewhat closer to the vessel base portion 30, a ring electrode such as depicted in FIG. 1 may not be required. Instead, the draft tube 6 is formed of an insulative material and an annular electrode 36 is attached to the draft tube inlet 22. A conventional variable voltage source (not herein illustrated) is connected to the annular electrode 36 while the vessel base portion 30 is suitably grounded.

Figure 3:
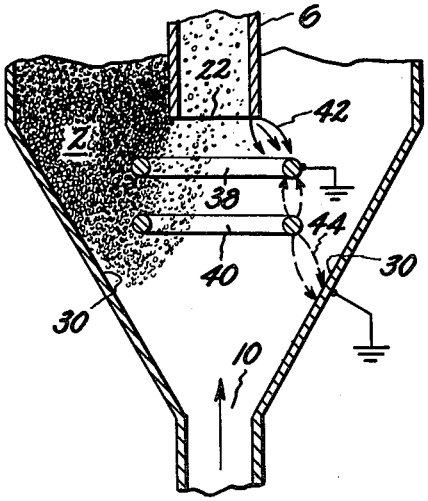
FIG. 3 is a view as in FIG. 2 depicting an electric field forming means according to yet another embodiment of the present invention.

In yet another electrode configuration as depicted in FIG. 3, two ring electrodes 38 and 40 are positioned in the spout inlet region 28. In this embodiment, the upper ring electrode 38 and the vessel base portion 30 are suitably grounded while the draft tube inlet 22 and the lower ring electrode 40 are connected to conventional voltage supplies (not herein illustrated) of the same polarity. In this configuration, two different electric fields are obtainable. In particular, by charging the draft tube inlet 22 an electric field 42 is formed of a suitable shape to enable the channeling of fluid flowing from the inlet 8 into the draft tube inlet 22, while also providing a partial recirculation control. Upon application of a voltage to the electrode 40 an electric field comprising electric fields 42 and 44 is formed which enables the control of granular bed material recirculation as described hereinabove.

A series of experiments were conducted using a semi-circular cross-sectional vessel constructed of an acrylic cylinder $6\frac{3}{8}''$ in diameter and 4' in length, which cylinder was cut lengthwise along the axis. The cut portion of the vessel was fitted with a flat acrylic plastic sheet to permit direct observation of spout behavior and particle motions in an associated granular bed. The fluid inlet was a $\frac{1}{2}''$ diameter brass tube transitioned to a semi-circular cross-section 6" from the inlet. A piece of 40×40-screen formed the vessel base section and also acted to keep bed particles out of the fluid inlet. The bed granules employed in these experiments were glass particles which were periodically treated with a conductive surface coating and which were approximately 590 μm to 710 μm in diameter. The draft tube consisted of a 9" length of ⅝" diameter brass tubing. A half-ring electrode was mounted coaxial with the draft tube and approximately midway between it and the fluid inlet. A conductive foil was bonded to the vessel base section, and both the draft tube and the foil were grounded. Finally, a high voltage connection was made to ring electrode. This arrangement served to concentrate electric field force lines in the spout inlet region of the vessel.

For flow rates from 0.001 to 0.0018 $m^3$/sec. the pressure drop across the bed decreased monotonically from zero applied voltage to approximately 25 Kv. At about this voltage granules in the spout inlet region tended to freeze and recirculation stopped. The voltage at which granule freezing occurs fluctuated in the experiments between 22.5 and 30 kilovolts. Both negative and positive polarities were employed with trends suggesting the negative polarity is more effective in the obtainment of desired particle recirculation control. From visual observations it was apparent that particle recirculation could be decreased by as much as approximately 50% before spout inlet region freezing occurs as the voltage is increased. Additionally, a hysteresis effect was noted in which the region, once frozen, tended to remain in the frozen state until the voltage was reduced substantially below the voltage required for initial freezing.

The above described embodiments of this invention are intended to be exemplitive only and not limiting and it will be appreciated from the foregoing by those skilled in the art that many substitutions, alterations and changes may be made to the disclosed device and method without departure from the spirit or scope of the invention.

What is claimed is:

1. A spouted bed device comprising;

a vessel for containing semi-insulating granular material which vessel includes a fluid inlet disposed in a vertically lower section thereof;

a tubular member having an inlet located within the vessel vertically above and in flow communication with the vessel fluid inlet; and means for forming an electric field within the vessel which field impinges upon the tubular member inlet.

2. A spouted bed device comprising;

a vessel for containing semi-insulating granular material which vessel includes a fluid inlet disposed in a vertically lower section thereof;

a tubular member having an inlet located within the vessel vertically above and in flow communication with the vessel fluid inlet; and means for forming an electric field between the tubular member inlet and a portion of the vessel lower section adjacent the fluid inlet, the field being suitable for maintaining granules of the vessel contained material along the force lines thereof.

3. A spouted bed device comprising;

a vessel having a fluid inlet disposed in a vertically lower section thereof, a bed of semi-insulating granules contained in the vessel, a tubular member having an inlet immersed in the granular bed in flow communication with the fluid inlet and spaced a distance from the fluid inlet much larger than the cross dimensions of an individual granule, a spout inlet region of the vessel extending from the tubular member inlet to a portion of the vessel interior surface adjacent the fluid inlet, and means for forming an electric field in the spout inlet region, the field acting to restrict the passage of granules from the spout inlet region into fluid flowing from the fluid inlet into the tubular member inlet.

4. A device as in claim 3 including means for forming an electric field in a portion of the spout inlet region extending from the tubular member inlet to a point intermediate the tubular member inlet and the vessel interior surface, which field acts to restrict the passage of granules from said portion of the spout inlet region into fluid flowing from the fluid inlet to the tubular member inlet.

5. A device as in claim 3 including a means for forming an electric field in the spout inlet region and impinging both on the tubular member inlet and on the vessel interior surface which field acts to restrict the passage of granules from the spout inlet region into fluid flowing from the fluid inlet into the tubular member inlet.

6. A device as in claim 3 wherein the granular bed terminates vertically below the top of the vessel so as to define a fountain region therebetween, and in which device the outlet of the tubular member is disposed within the fountain region.

7. A device as in claim 3 in which the outlet of the tubular member is disposed outside of the vessel so as to enable the transfer of granules out of the vessel through the tubular member.

8. A spouted bed device comprising;

a vessel for containing semi-insulating granular material and having a vertical axis, which vessel includes a substantially frustoconical downwardly tapering base section having a fluid inlet at the apex thereof;

a tubular member positioned substantially coaxially in the vessel and having an inlet disposed opposite of and spaced from the vessel fluid inlet;

a spout inlet region of the vessel between the tubular member inlet and a portion of the vessel base section interior surface adjacent the fluid inlet; and a means for forming a localized electric field in the spout inlet region.

9. A device as in claim 8 in which the electric field forming means comprises an annular electrode disposed in the spout inlet region coaxial with the tubular member and intermediate the tubular member inlet and the vessel base section portion, and in which said means further comprises means for providing the tubular member inlet and the portion of the base section with a first electrical potential and the annular electrode with a second electrical potential different than the first potential.

10. A device as in claim 8 wherein the electric field forming means comprises an annular electrode mounted on the tubular means adjacent the inlet thereof, and a means for providing an electrical potential between the electrode and a portion of the base section adjacent the fluid inlet.

11. A method for controlling spout inlet conditions in a spouted bed device having a draft tube positioned vertically in a granular semi-insulating material containing vessel so as to define an annular bed of granules therebetween, with said vessel having a fluid inlet in a base section thereof spaced from and opposite the draft tube inlet so as to define a spout inlet region between the draft tube inlet and a portion of the base section adjacent the fluid inlet, which method comprises the steps of;

directing a jet of fluid from the fluid inlet through the spout inlet region towards the draft tube inlet, entraining granules in the fluid to form a dilute suspension, transferring the dilute suspension from the spout inlet region through the tubular member, replacing entrained granules with granules from the annular bed, and imposing a localized electric field on at least a portion of the granules in the spout inlet region to regulate the granule entrainment therefrom so as to control the spout inlet conditions of the spouted bed device.

12. A method as in claim 11 in which the rate of granule entrainment is maintained substantially constant while increasing the flow rate of the fluid jet by increasing the strength of the imposed electric field in the spout inlet region.

13. The method as in claim 11 in which the electric field is imposed across substantially all of the spout inlet region and in which the rate of granule entrainment is decreased by increasing the strength of the imposed field.

14. A method as in claim 11 in which the jet of fluid is directed into the draft tube inlet by imposing an electric field in the spout inlet region with force lines extending from the draft tube inlet towards the fluid inlet, and by adjusting the strength of the imposed field so as to align a plurality of semi-insulating granules in the spout inlet region along the lines of force of the imposed field.

* * * * *